US005464954A

United States Patent [19]

Kimura et al.

[11] Patent Number: 5,464,954

[45] Date of Patent: Nov. 7, 1995

[54] SAFETY SWITCH ASSEMBLY

[75] Inventors: Haruo Kimura, Kyoto; Yoshio Sekino, Osaka; Takashi Masuya, Osaka; Takao Fukui, Osaka, all of Japan

[73] Assignee: Idec Izumi Corporation, Osaka, Japan

[21] Appl. No.: 232,227

[22] PCT Filed: Aug. 31, 1993

[86] PCT No.: PCT/JP93/01226

§ 371 Date: Jul. 19, 1994

§ 102(e) Date: Jul. 19, 1994

[87] PCT Pub. No.: WO94/06141

PCT Pub. Date: Mar. 17, 1994

[30] Foreign Application Priority Data

| | | | |
|---|---|---|---|
| Aug. 31, 1992 | [JP] | Japan | 4-231031 |
| Aug. 31, 1992 | [JP] | Japan | 4-231032 |
| Oct. 21, 1992 | [JP] | Japan | 4-073395 |
| Nov. 2, 1992 | [JP] | Japan | 4-075947 |
| Aug. 4, 1993 | [JP] | Japan | 5-193365 |

[51] Int. Cl.[6] ..... H01H 27/00

[52] U.S. Cl. ..... 200/61.62; 200/43.04; 200/43.07; 200/61.66; 200/333; 200/573

[58] Field of Search ..... 200/17 R–18, 200/43.02, 43.04, 43.07, 43.08, 61.62–61.69, 334, 520, 533, 573; H01H 27/00, 27/06, 27/10

[56] References Cited

U.S. PATENT DOCUMENTS

| | | | |
|---|---|---|---|
| 4,395,608 | 7/1983 | Eicker et al. | 200/61.62 X |
| 4,524,251 | 6/1985 | Schulz | 200/43.07 |
| 4,658,102 | 4/1987 | Seim et al. | 200/17 R |
| 4,695,684 | 9/1987 | Bochard et al. | 200/43.07 |
| 4,904,829 | 2/1990 | Berthaud et al. | 200/61.62 X |
| 4,963,706 | 10/1990 | Mohtasham | 200/61.62 X |

FOREIGN PATENT DOCUMENTS

| | | | |
|---|---|---|---|
| 124332 | 5/1989 | Japan | H01H 27/00 |
| 421037 | 2/1992 | Japan | H01H 27/00 |
| 452321 | 5/1992 | Japan | H01H 3/16 |
| WO9008396 | 7/1990 | WIPO | H01H 27/00 |

*Primary Examiner*—J. R. Scott

*Attorney, Agent, or Firm*—Panitch Schwarze Jacobs & Nadel

[57] ABSTRACT

The safety switch unit controls the source of power for machinery in accordance with the opening and closing of a room door. The safety switch includes an actuator (2) secured to a door, a cam shaft extending transversely of a direction in which the actuator (2) advances into the switch unit (1), the actuator (2) having a stepped top end in correspondence to which cam plates (13), (14*a*) and (14*b*) are provided within the switch unit (1) each capable of independently rotating, these cam plates having start sides (17) and (22) and a single cam follower pin (29) passed therethrough, thus protecting the switch unit (1) against mischievous or malicious operation.

6 Claims, 17 Drawing Sheets

SAFETY SWITCH ASSEMBLY

BACKGROUND OF THE INVENTION

1. Field of the Invention

The present invention relates to a safety switch for use in stopping machinery in any emergency so as to protect the operators against an accident which may result in injury or death.

2. Background Art

In factories or any sites where machinery is in operation, various types of safety switch are used so as to stop the machinery when any emergency occurs, or when a normally shut room door is carelessly left open or when a protective cover of the machinery is carelessly left open.

For example, PCT 90/08396 Publication (laid open on Jul. 26, 1990) discloses a safety switch using a pair of locking cams that are expanded sideways in response to the entry of an actuator. Japanese patent Publication (allowed) No. 1-24332 (published on May 11, 1989) discloses a safety switch also uses locking cams that are expanded in response to entry of an actuator. A disadvantage in common with these two prior art safety switches is that the body must be large enough to allow for the expansion of the arms.

The known switches are designed to shift a movable contact point from a fixed contact point to the other fixed contact point in accordance with the entry of an actuator but the problem is that deenergization is likely to occur before the door is completely locked.

THE SUMMARY OF THE INVENTION

According to the present invention, the safety switch assembly controls a source of power for machinery in accordance with the opening (or closing of) a room door, a cover or any other means provided for protecting workers against danger. The switch assembly, compact in size, switches off the machinery when the protective door is opened or when it is left half open, wherein the movement or the position of the door is transmitted to the switch assembly through an actuator secured to the door, the actuator being shaped to a unique form which can not be shared by any other thing, thus protecting the switch assembly against mischievous or malicious operation.

BRIEF DESCRIPTION OF THE DRAWINGS

FIGS. 15(*a*)' to 15(*d*)' are diagrammatic plan views respectively corresponding to FIGS. 15(*a*) to 15(*d*);

FIGS. 16(*a*)' to 16(*d*)' are diagrammatic plan views respectively corresponding to FIGS. 16(*a*) to 16(*d*);

BEST MODE OF EMBODIMENT

Figure 1:
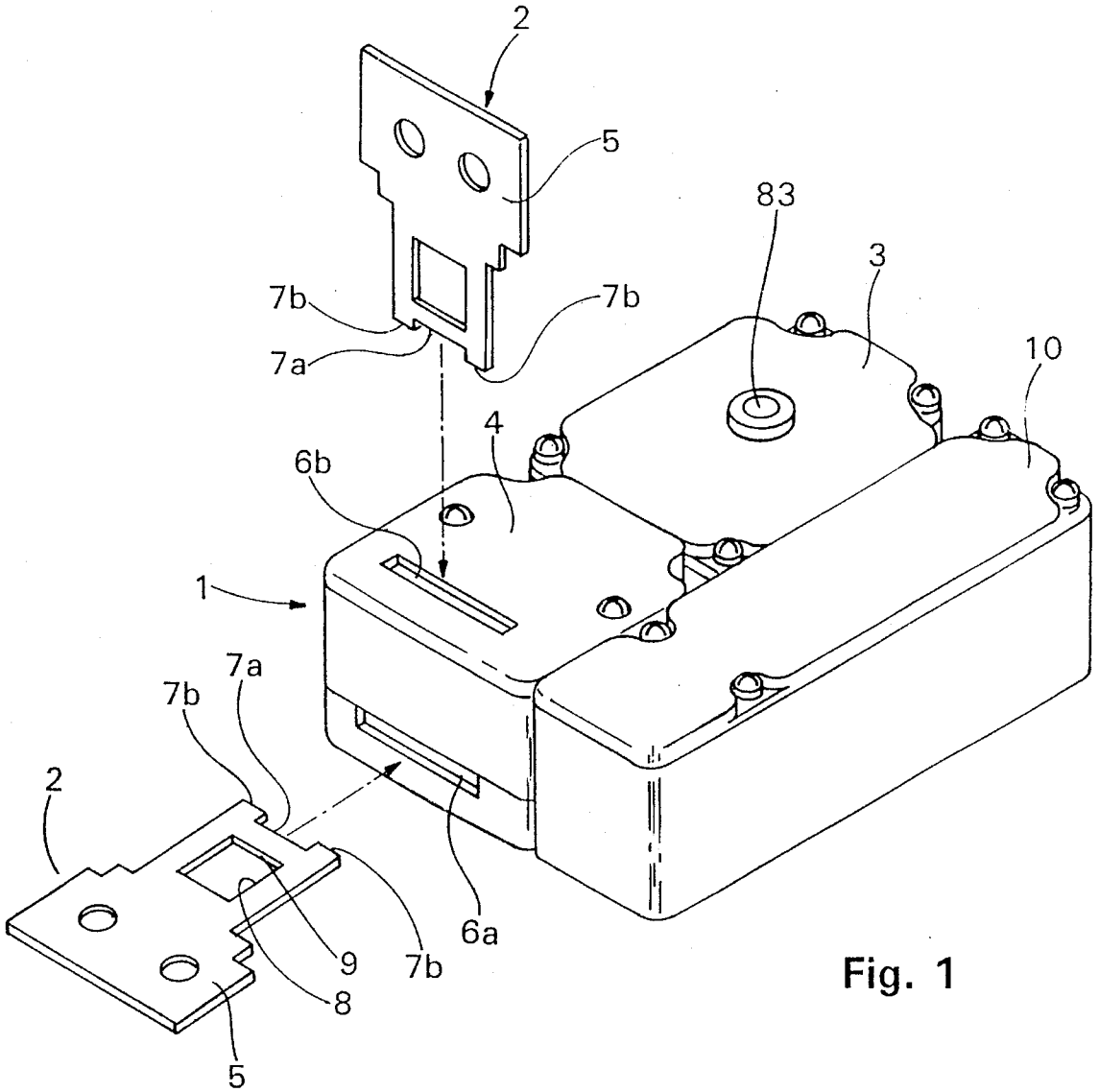
FIG. 1 is a perspective view showing a switch assembly embodying the present invention.

Referring to FIG. 1, a switch assembly 1 is attached to a wall at a place near to a protective door (not shown) in such a manner as to enable an actuator 2 secured to the door. When the door is closed, the actuator is inserted in the switch assembly 1 and locked therein, thereby locking the door. The door is unlocked only when the actuator 2 is disengaged from the switch assembly 1. The switch assembly 1 has two slits 6*a* and 6*b* which allow the entry of the actuator 2. The slits 6*a* and 6*b* are produced in planes crossing at right angle. Either slit 6*a* or 6*b* is selected depending upon the position of the door. The switch assembly 1 includes an operating block 4, a contact-point block 3, and an actuator releasing block 10, which are mutually detachably coupled together by means of screws in the form of a box as seen from FIG. 1. The contact-point block 3 is provided with a lens 83 as a lighting indicator. The actuator 2 includes a base plate 5 joined to the door (not shown). The base plate 5 includes operating portions 7*a* and 7*b* which are inserted into the switch assembly 1. The portion 7*a* is a recessed portion, and the portion 7*b* are projecting portions, with the recessed portion 7*a* interposed therebetween. The base plate 5 is provided with an aperture 8 designed to accept lower parts of the cam plates 13, 14*a* and 14*b* so as to release them from a locking mechanism, which will be referred to below. The aperture 8 has a wall portion 9 toward the switch assembly 1, which functions to enable the actuator 2 to return to its original position after it is disengaged from the switch assembly 1.

Figure 2:
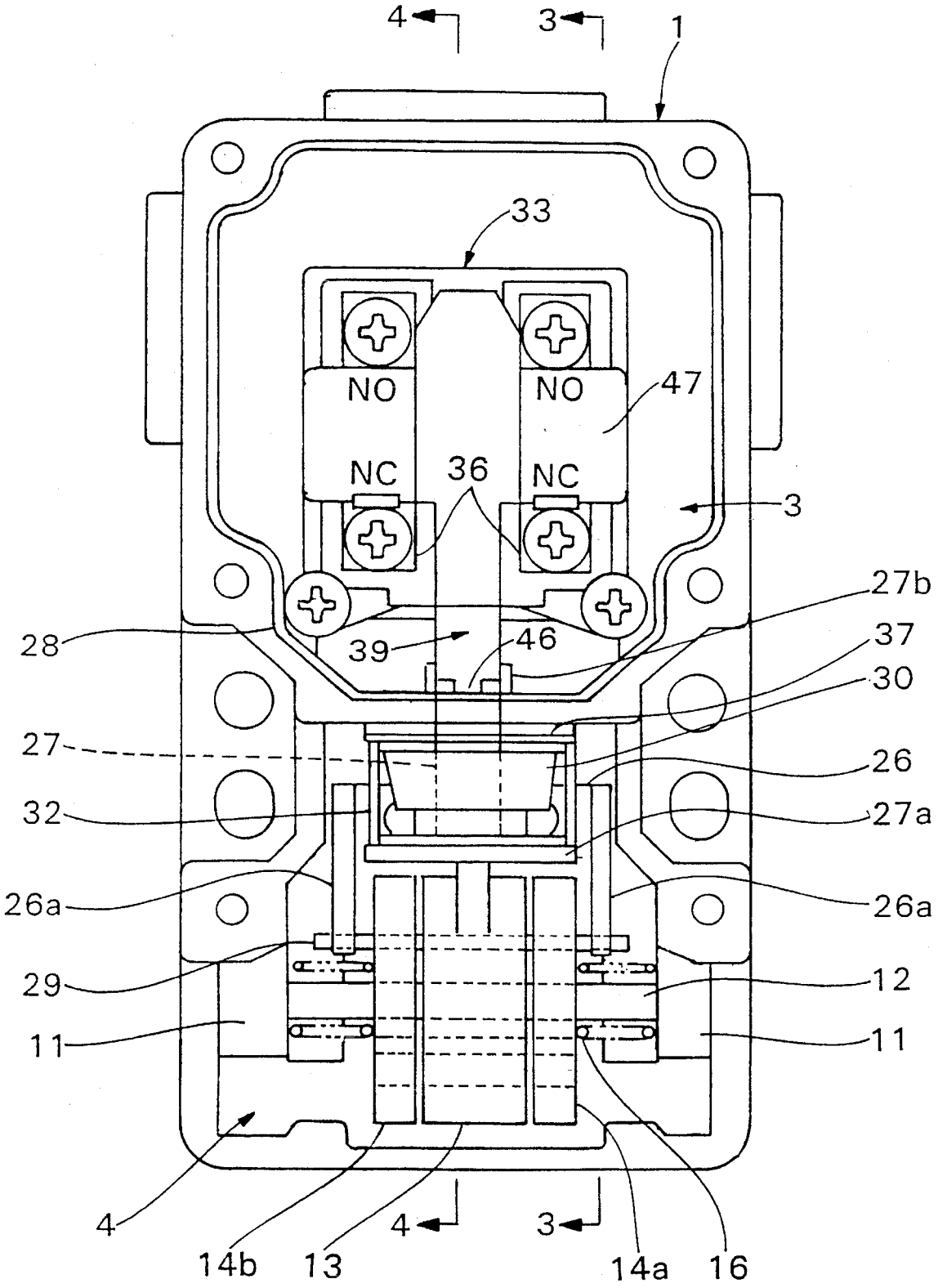
FIG. 2 is a plan view showing the operating block and the contact-point block of the switch assembly with the cover being removed.
Figure 3:
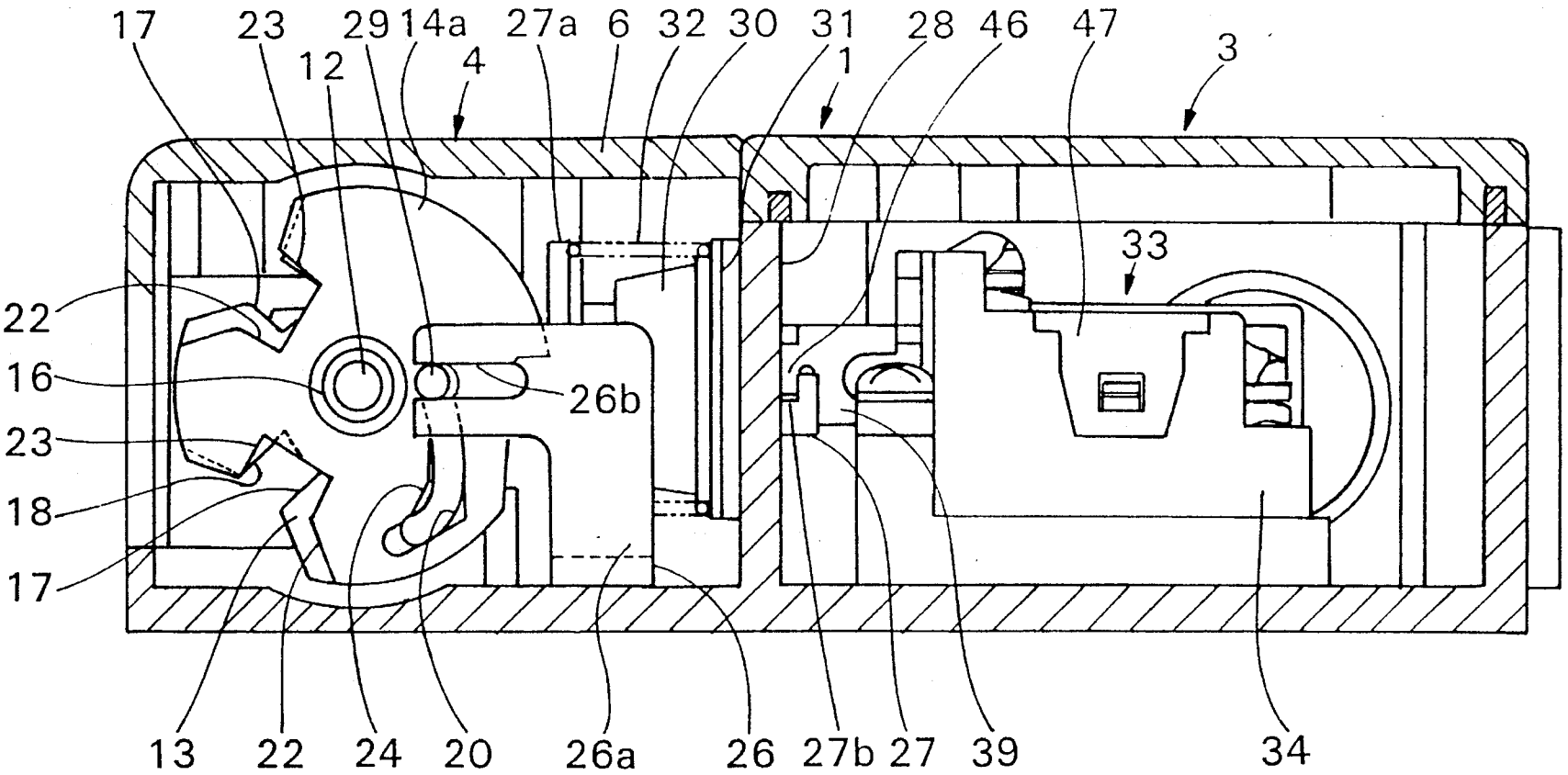
FIG. 3 is a cross-sectional view taken along the line 3—3 in FIG. 2.
Figure 4:
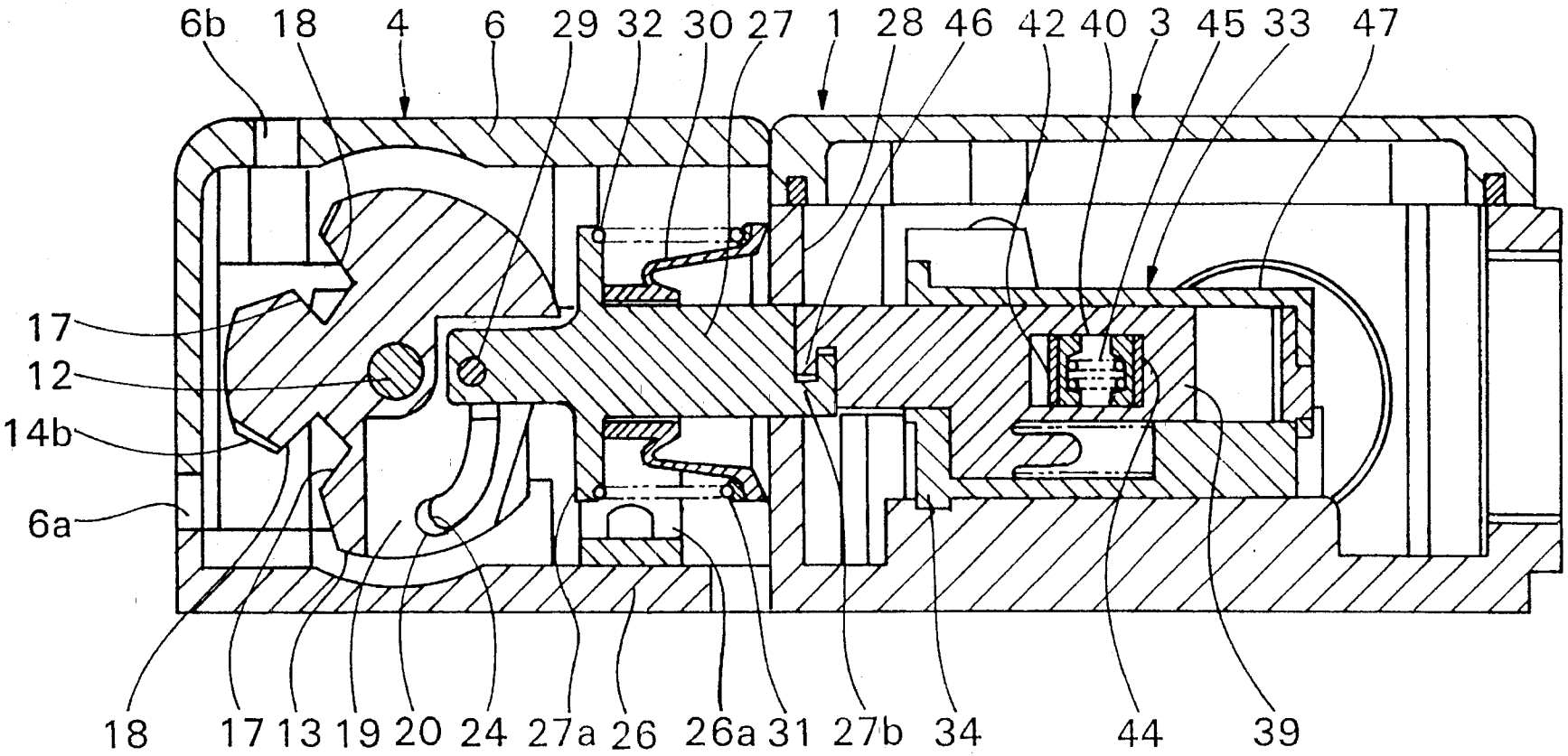
FIG. 4 is a cross-sectional view taken along the line 4—4 in FIG. 2.

Referring to FIGS. 2, 3, and 4, the operating block 4 includes a pair of supports 11 which supports a cam shaft 12 carrying a first cam plate 13, and a pair of second cam plates 14*a* and 14*b*, all of these cam plates being independently rotatable. The independent rotation is effected by washers inserted between the first cam plate 13 and the second cam plates 14*a*, 14*b*. Each of the second cam plates 14*a* and 14*b* has a spring against the support 11. The springs bias the second cam plates 14*a* and 14*b* to return to its original position.

As more clearly shown in FIGS. 4 and 6, the first cam plate 13 has two recesses of the same shape which receive the actuator 2; one corresponding to the slits 6*a* and the other corresponding to the slit 6*b*, each recess having sides 17 and 18 wherein the sides 17 work to put the cam plate 13 into operation and the sides 18 work to return the cam plate 13 to its original position. Hereinafter, the sides 17 will be referred to as "start sides" and the sides 18 as "return sides". The cam plate 13 has a sectorial recess 19 about at 90° so as to enable an operating rod 27 to play therein. The sectorial recess 19 has a cam groove 20 in the bottom wall. The cam groove 20 receives a cam follower pin 29 secured to the operating rod 27, the follower pin 29 being slidable in the groove 20. The cam groove 20 has a pin rest hole 21 at the starting end; in FIG. 6(*a*) it will be seen that the pin rest hole 21 is slightly bulged to the right. The second cam plates 14*a* and 14*b* have start sides 22 and return sides 23, and cam grooves 24 which has a pin rest hole 25 bulged to the right in FIG. 7. The cam follower pin 29 passes through the cam grooves 20 and 24.

As shown in FIG. 3, there is provided an L-shaped post 26 fixed behind the cam plates 13, 14*a* and 14*b*, the guide 26 including a pair of posts 26*a* erected on each side. Each post 26 has a guide slot 26*b* in which the follower pin 29 is shiftable. The operating rod 27 referred to above is disposed along the guide 26, with a spring 27*a* at the center which is adapted to receive a spring. The operating rod 27 is retractably inserted into a casing 34 which houses a switch section 33. The operating rod 27 is integral with the cam follower pin 29 projecting crosswise thereof and the cam follower pin 29 passes through the cam grooves 20 and 24 of the cam plates 13, 14*a*, and 14*b* and are supported by the guides 26 on both sides. Thus the operating rod 27 is prevented by the guides 26 from swinging sideways while it moves forward and backward (right and left in FIGS. 3 and 4). The operating rod 27 is provided with a hook 27*b* at the rear end, which is engaged with a hook 46 of a switching rod 39. The operating rod 27 and switching rod 39 is normally connected by engagement of the hooks 27*b* and 46 so as to effect a unitary movement. The space existing between the spring 27*a* and a switch case 28 is sealed against water by a rubber bellows 30. Outside the bellows 30, a spring 32 is disposed between the spring 27*a* and a base 31 of the bellows 30, so as to bias the operating rod 27 forward (to the left in the drawings). When the operating rod 27 is fully shifted to the left as shown in FIGS. 3 and 4, the follower pin 29 fit in the pin rest holes 21 and 25 of the grooves 20 and 24. Hereinafter, this stage will be referred to as the "initial stage". At this initial stage, the cam plates 13, 14*a* and 14*b* are ready to receive the operating portions 7*a* and 7*b* of the actuator 2 with the follower pins 29 ready to slide in and along the cam grooves 20 and 24.

Figure 5:
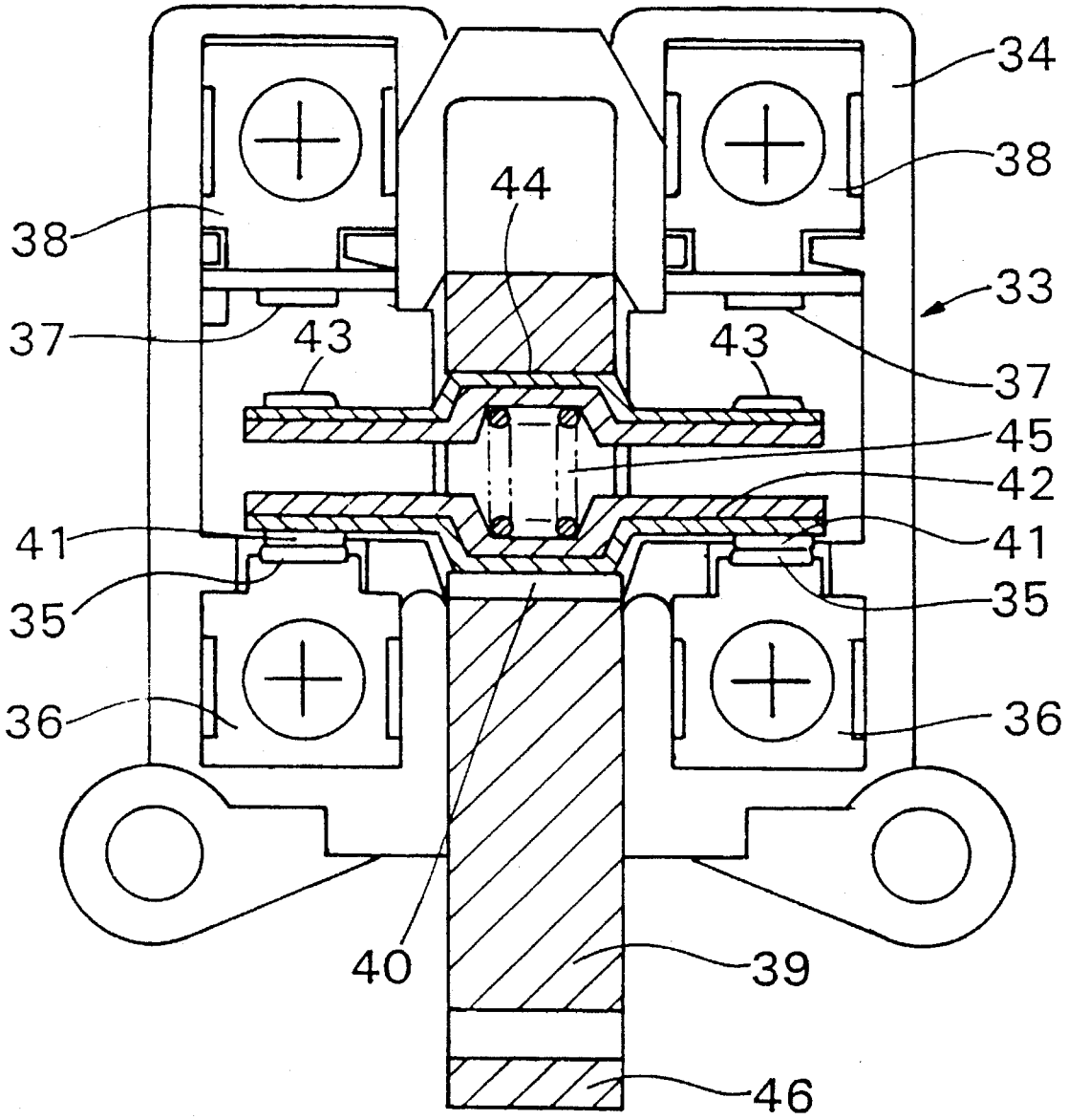
FIG. 5 is a plan view of the contact-point block showing the internal structure thereof.
Figure 6A:
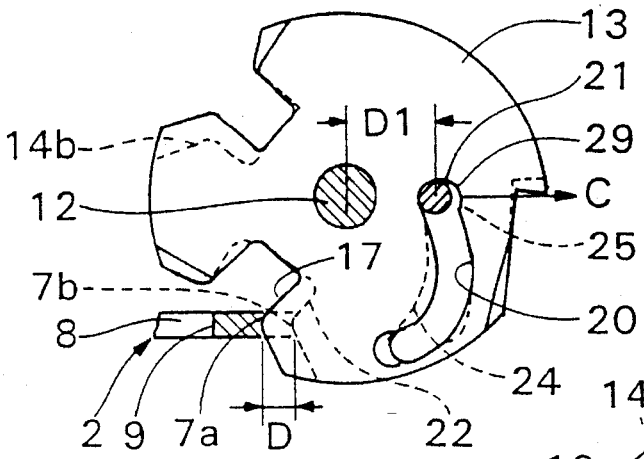
FIGS. 6(*a*) to 6(*e*) are diagrammatic views showing the interaction of the actuator and the cam plates in the switch assembly.
Figure 6B:
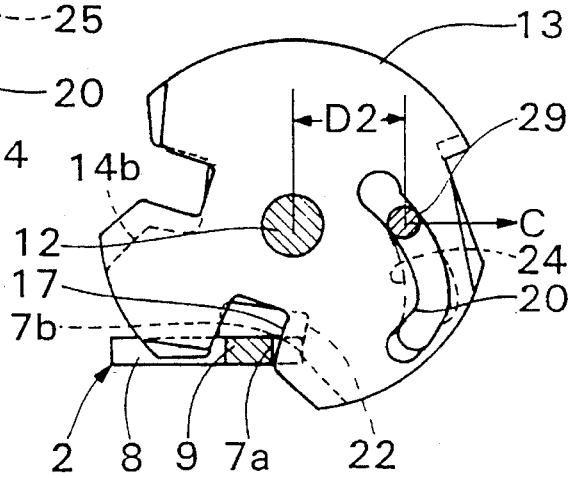
Figure 6C:
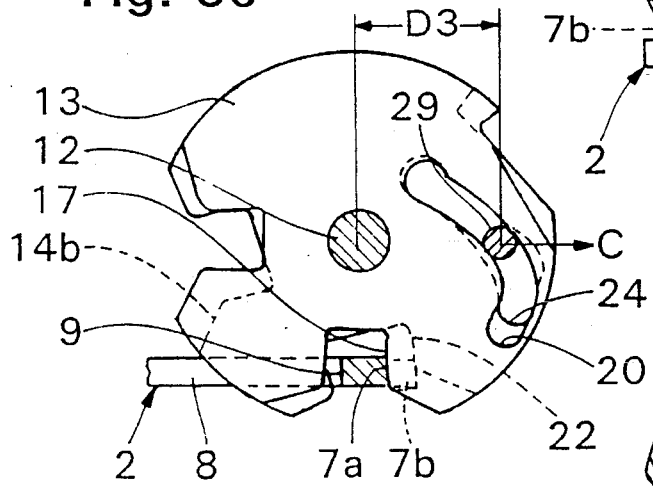
Figure 6D:
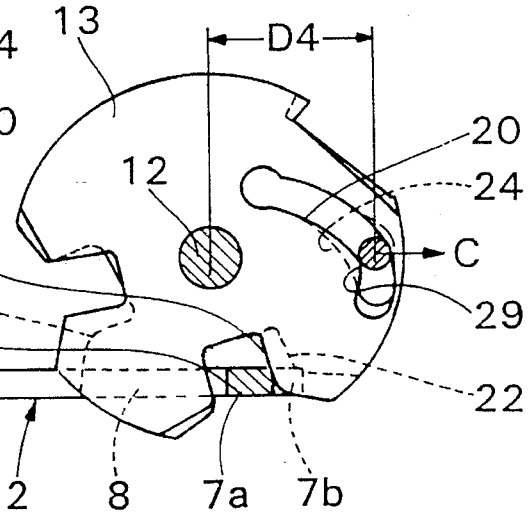
Figure 6E:
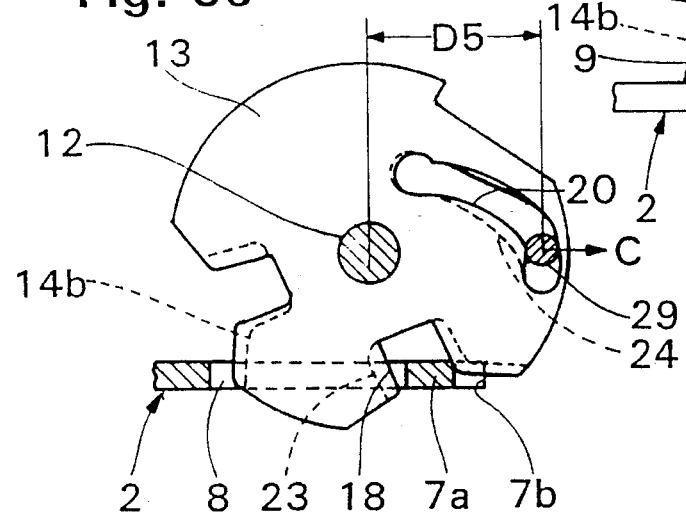
Figure 7A:
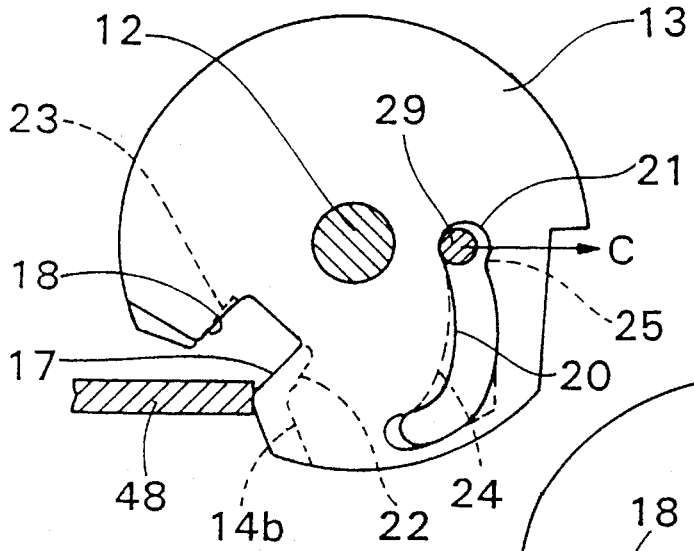
FIGS. 7(*a*) to 7(*d*) are diagrammatic views showing the interaction of the cam plates and a substitute actuator.
Figure 7B:
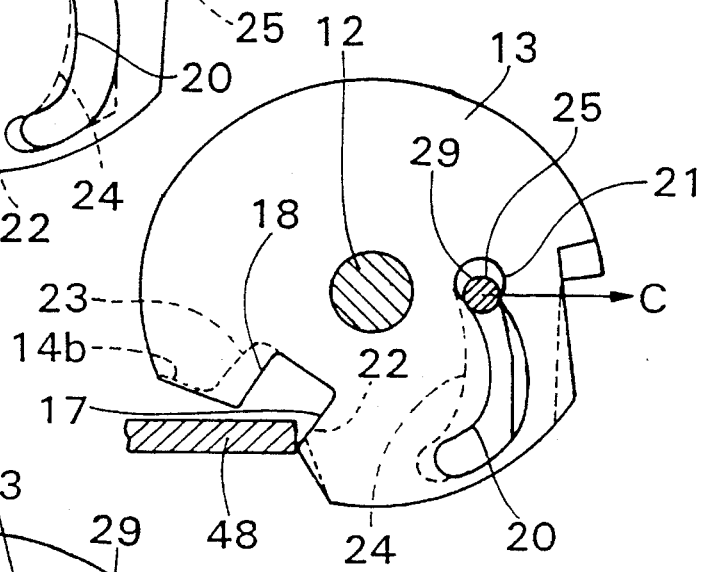
Figure 7C:
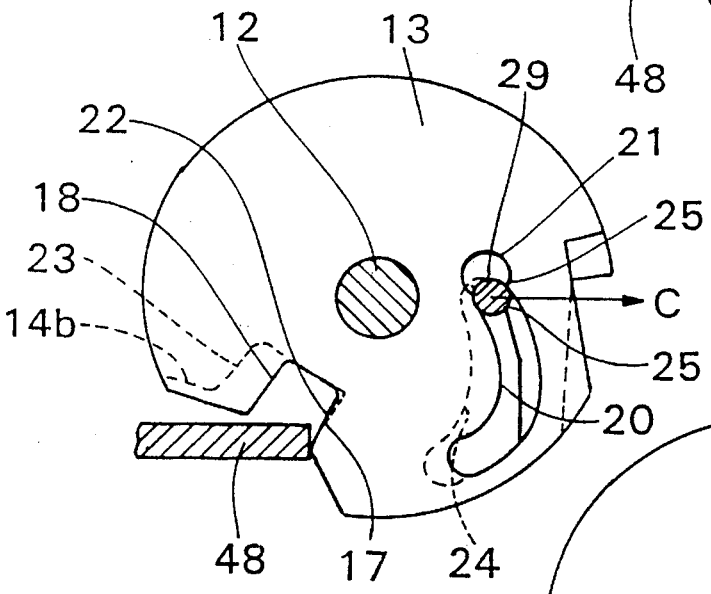
Figure 7D:
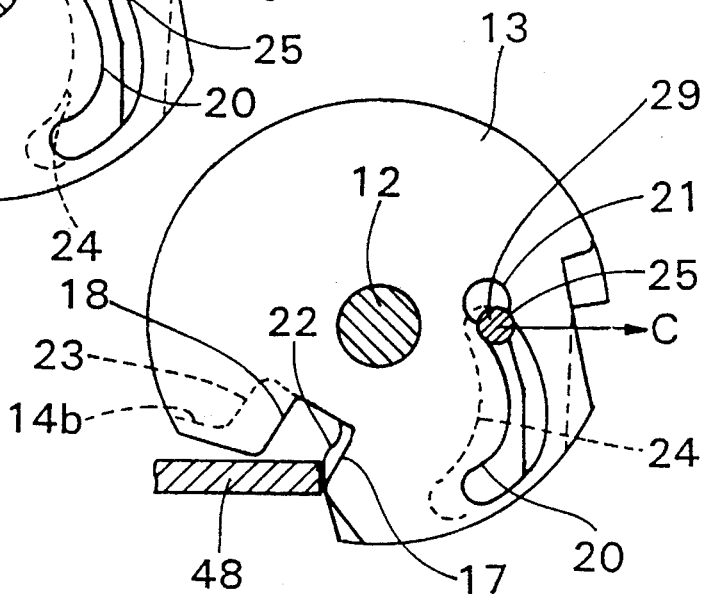
Figure 8A:
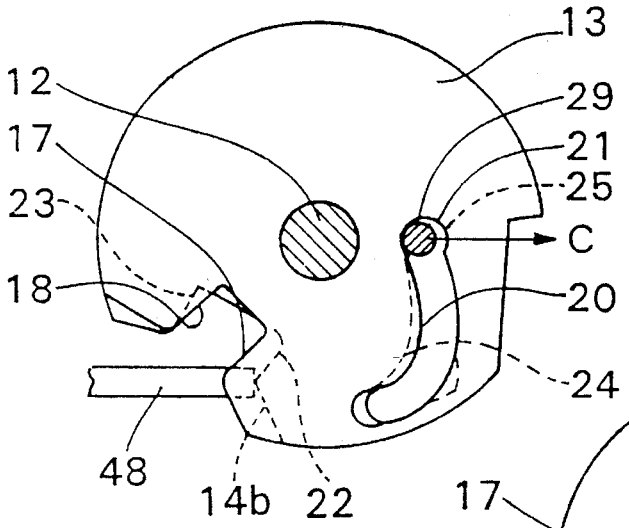
FIGS. 8(*a*) to 8(*d*) are diagrammatic views showing the interaction of the cam plates and another substitute actuator.
Figure 8B:
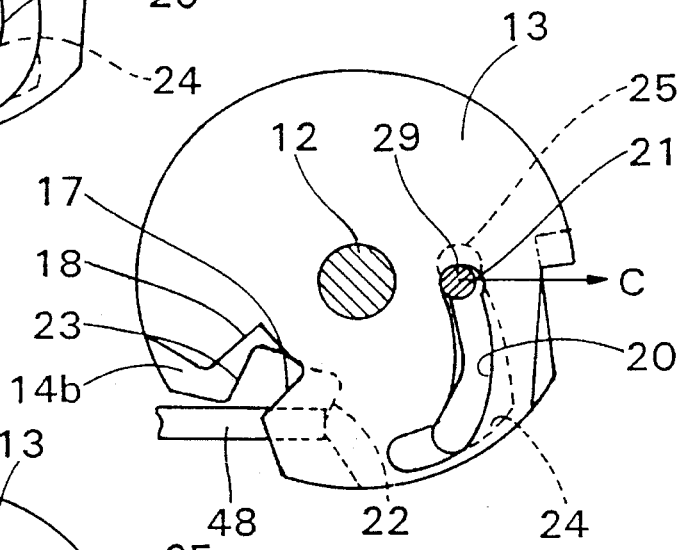
Figure 8C:
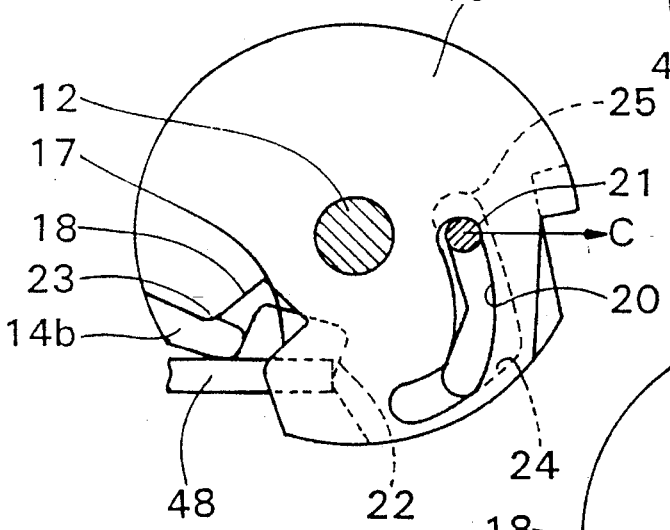
Figure 8D:
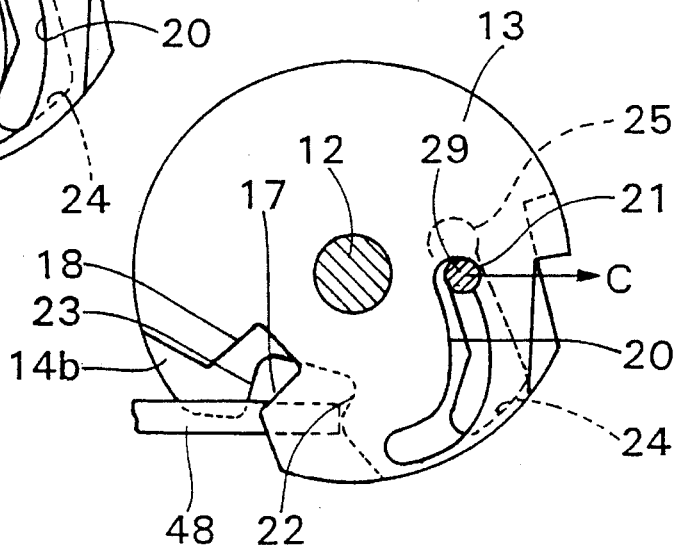

Now, referring to FIGS. 4 and 5, the contact-point block 3 will be described:

The contact-point block 3 includes the switch case 28 referred to above which houses a switch section 33. The switch section 33 includes a pair of terminal plates 36 having fixed contact points 35 with which movable contact points 41 are normally kept in contact. A pair of terminal plates 38 having fixed contact points 37 with which movable contact points 43 are brought into contact when the switching rod 39 is worked in a manner described below. The switching rod 39 is provided with terminal plates 42 and 44 having the contact points 41 and 43, the terminal plates 42 and 44 being passed through an aperture 40 and spaced by a spring 45. The switching rod 39 is slidable axially with the switch assembly 1. As described above, the operating rod 27 and switching rod 39 can move as an assembly by engagement of the hooks 46 and 27*b* thereof. The contact points 35 and 41 are normally kept in contact with each other, and the contact points 37 and 38 are normally separated as shown in FIG. 5. The terminal plates 36 and 38 are electrically connected to a source of power for a machine (not shown) to be controlled by the switch assembly 1.

Referring to FIGS. 6 to 8, an example of the operation of the switch assembly 1 will be described:

While a protective cover (not shown) is opened, intentionally or carelessly, the actuator 2 becomes withdrawn from the switch assembly 1. This state is shown in FIGS. 2 to 4. The operating rod 27 and switching rod 39 are shifted forward (to the left) as shown in FIGS. 2 to 4 under the action of the spring 32, thereby enabling the cam follower pin 29 to rest in the pin rest holes 20 and 24 of the cam grooves 20 and 24. FIG. 6(*a*) shows this initial stage where the sides 17 of the cam plates 13 and the side 22 of the cam plates 14*a* and 14*b* are not in the same level but they receive the recessed portion 17*a* in the side 17 and the projecting portions 17*b* in the side 20. FIG. 5 shows the switch section 33 at this stage where the contact points 35 and 41 are kept in contact under the action of the spring 45, and the contact points 43 stand away from the fixed contact points 37.

When the protective door is closed, the actuator 2 advances into the switch assembly 1 by a distance D (FIG. 6(*a*)) through the slit 6*a* (or 6*b*), the portions 17*a* and 17*b* of the actuator 2 come into engagement with the sides 17 and 22 of the cam plates 13, 14*a*, and 14*b*. In FIGS. 6(*a*) to 6(*e*) the arrow C indicates the direction in which the cam follower pin 29 slide in and along the guide slots 26*b* of the post 26 in accordance with the movement of the cam follower pin 29 in and along the grooves 20 and 24. D2, D3, D4 and D5 denote the distances between the cam shaft 12 and the cam follower pin 29.

The actuator 2 is further advanced into the switch assembly 1, thereby enabling the cam plates 13, 14*a* and 14*b* to rotate. The follower pin 29 is shifted in and along the cam grooves 20 and 24, and moves in the direction C in and along the guide slots 26*b*. The distance D1 changes into a distance D2 as shown in FIGS. 6(*a*) and 6(*b*). The operating rod 27 and switching rod 39 are moved together backward (to the right), thereby separating the movable contact points 41 from the fixed contact points 35. The operating rod 27 can smoothly move because of the less frictional two-point support by the posts 26 and switch case 28.

When the cam follower pin 29 stands away from the cam shaft 12 by a distance D3 (FIG. 6(*c*)) where the pin 29 reaches a middle point of the grooves 20 and 24, the contact points 35 and 41 are separated from each other in accordance with the backward movement of the switching rod 39. When the distance becomes D4 (FIG. 6(*d*)), the contact points 43 come into engagement with the contact points 37 under the action of the spring 45. When the actuator 2 is completely inserted into the switch assembly 1, the distance between the cam shaft 12 and the pin 29 reaches D5 (FIG. 6(*e*)), which is the maximum.

When the contact points 43 are brought into engagement with the contact points 37, parts of the cam plates 13, 14*a* and 14*b* fit in the aperture 8 of the actuator 2 where the return sides 18 and 23 are opposed to the wall portion 9 of the aperture 8. When the door is opened thereby to cause the actuator 2 to withdraw from the switch assembly 1, the wall portion 9 pushes the return sides 18 and 23 to cause the cam plates 13, 14*a*, and 14*b* to rotate in the clockwise direction in FIG. 6. The rotation of the cam plates 13, 14*a* and 14*b* are accompanied by the forward movement of the operating rod 27 and switching rod 39, thereby separating the contact points 43 from the contact points 37. In this way it is ensured that the contact points 37 and 43 are opened in accordance with the withdrawal of the actuator 2 from the switch assembly 1.

FIGS. 7 and 8 show a case where the actuator 2 is replaced by an ordinary screw-driver 48 for insertion into the switch assembly 1. FIG. 7(*a*) to 7(*d*) show the process of operating the cam plate 13 alone (the cam plates 14*a* and 14*b* are left stationary) wherein like reference numerals designate like components to those throughout FIGS. 1 to 6. The other side of the cam plate 13 is also omitted from illustration.

The driver 48 is inserted by hand into the switch assembly 1 through the slit 6*a* (FIG. 7(*a*)) and comes into abutment with the start side 17 of the cam plate 13. The further insertion of the driver 48 causes the cam plate 13 to rotate so that the cam follower pin 29 is shifted in and along the guide slot 26*b* of the posts 26 in the direction C (FIGS. 7(*b*) and 7(*c*)). The pin 29 fits in the pin rest holes 25 of the cam plates 14*a* an 14*b* which remain stationary (FIG. 7(*d*)) whereby the movement of the pin 29 in the direction C is stopped. Thus the cam plates 13, 14*a* and 14*b* are stopped from rotation. The same takes place when any other tool than a screw driver is used.

FIG. 8 shows a case where the cam plate 14*b* alone is tried to rotate by a screw-driver 48 with the cam plates 13 and 14*a* remaining stationary. The screw driver 48 is inserted by hand into the switch assembly 1 through the slit 6*a* (FIG. 8(*a*)) and comes into abutment with the start side 22 of the cam plate 14*b*. The further insertion of the driver 48 causes the cam plate 14*b* to rotate so that the cam follower pin 29 is shifted in and along the guide slot 26*b* of the post 26 in the direction C (FIGS. 8(*b*) and 8(*c*)). The pin 29 fits in the pin rest holes 21 of the cam plate 13 which remain stationary (FIG. 8(*d*)) whereby the movement of the pin 29 in the direction C is stopped. The non-rotation of the cam plates 13 and 14*a* is maintained, and the cam plate lab is stopped from rotation.

Figure 9A:
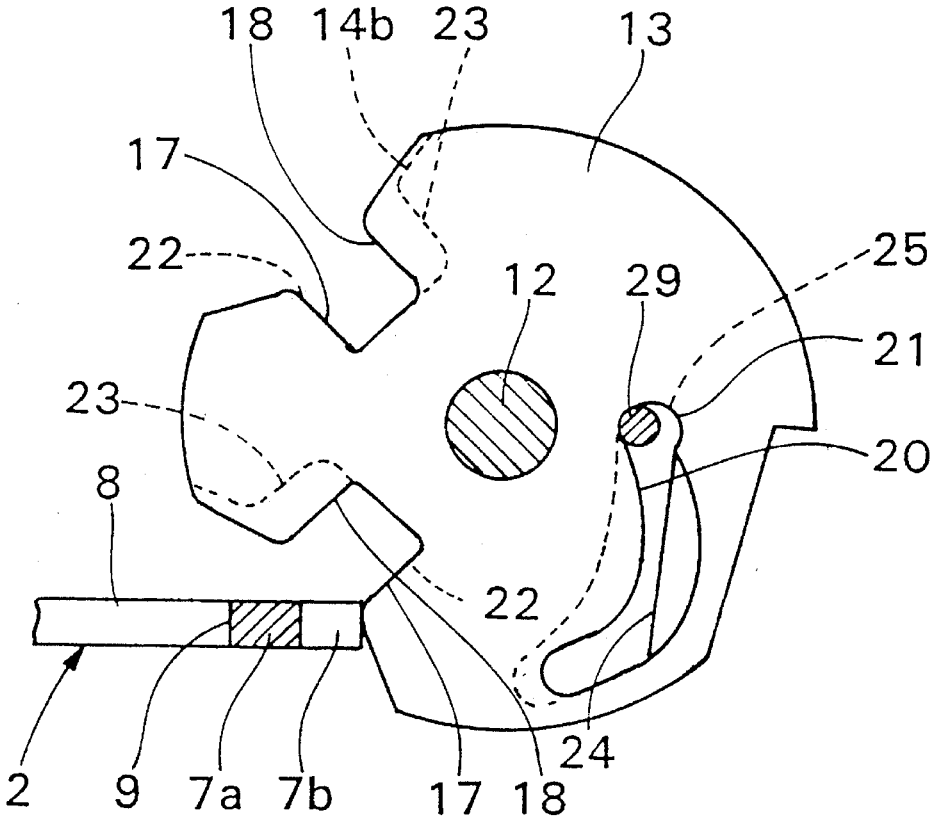
FIGS. 9(*a*) and 9(*b*) are diagrammatic views showing a modified version of the operating section of the switch assembly.
Figure 9B:
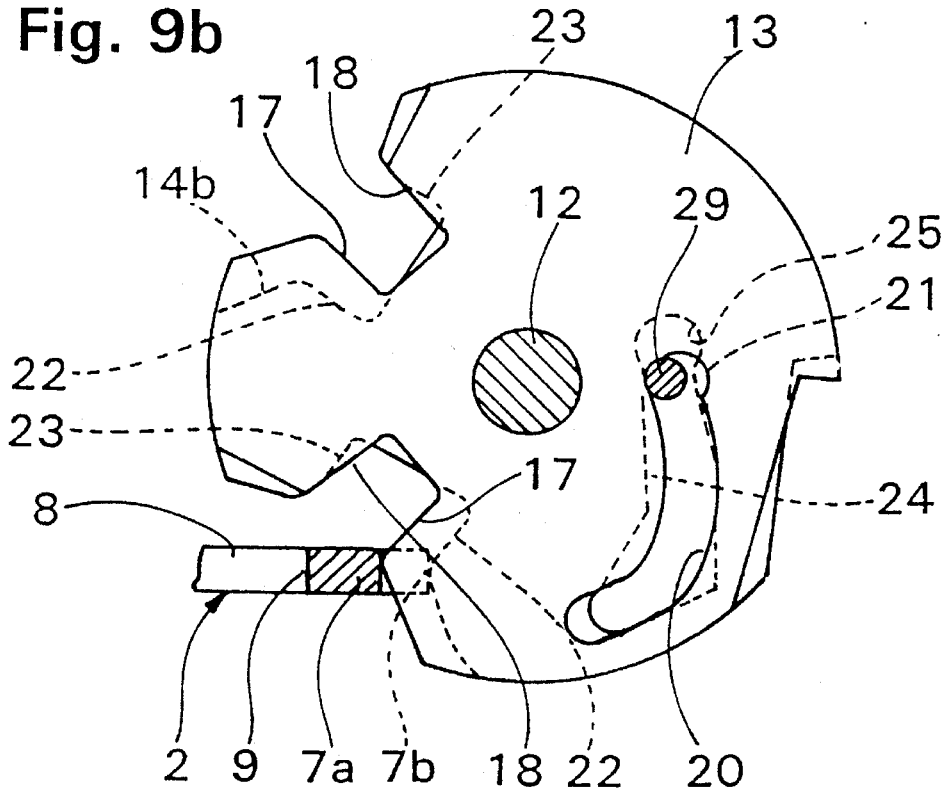

Referring to FIGS. 9(*a*) and 9(*b*), another example of the embodiment will be described wherein like reference numerals designate like components to those throughout FIGS. 1 to 8:

The feature of this modified example is that no angular displacement exists among the cam plates 13, 14*a* and 14*b* at the initial stage, and therefore, and between the start sides 17 and 22 but that an angular displacement exists between the the cam grooves 20 and 24 so that the not overlapping grooves can not allow the cam follower pin 29 to pass. In this situation the cam plates 13, 14*a* and 14*b* will not rotate even if any inserter other than the actuator 2 is inserted into the switch assembly 1. At this stage, when the actuator 2 is inserted through either the slit 6*a* or 6*b*, the projecting portions 7*b* of the actuator 2 cause the cam plates 14*a* and 14*b* to rotate, and then, as shown in FIG. 9(*b*), the recessed portion 7*a* comes into abutment with the start side 17 of the cam plate 13. Thus the cam grooves 20 and 24 overlap so that the cam follower pin 29 can slide therein. At the same time, the cam plates 13, 14*a* and 14*b* are returned to their original position of the initial stage where an angular displacement between the cam plate 13 and the cam plates 14*a*, 14*b* exists. Thereafter, they maintain the same position where the cam follower pin 29 can be guided.

In this example, any trial to rotate one of the cam plates by using a tool other than the actuator 2 will end in failure because the cam follower pin 29 persistently stays in the pin rest holes 21 and 25 of the other two cam plates whereby the cam plates remain stationary. In this example, as referred to above, no angular displacement exists among the cam plates 13, 14*a* and 14*b* at the initial stage, and a desired angular displacement must be first produced, and thereafter this displacement must be maintained so as to enable the cam plates 13, 14*a* and 14*b* to rotate to operate the operating rod 27 and the switching rod 39. Thus the switch assembly is protected against a mischievous or malicious trial to insert a tool into the switch assembly.

The example illustrated in FIGS. 2 to 4 can be assembled by assembling the contact-point block 3, and coupling it to the operating rod 27 of the block 4. The contact-point block 3 can be easily disassembled where necessary. The switch assemblies of the present invention are suitable for mass-production. One of the features is in the operating rod 27 which is connected to the switching rod 39 by engagement of the hooks 27*b* and 46.

Figure 10:
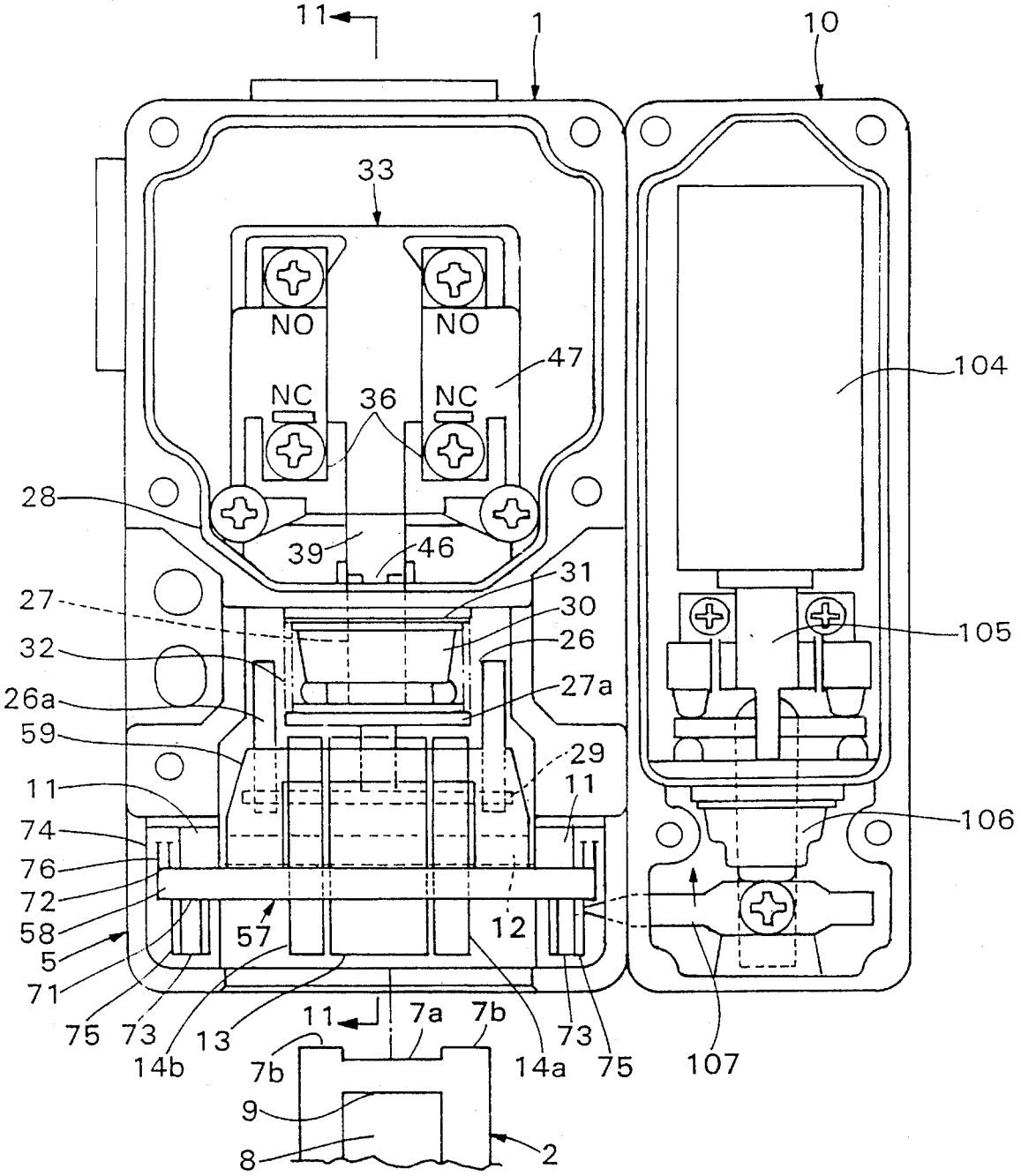
FIG. 10 is a plan view exemplifying the locking mechanism using a lock lever.
Figure 11:
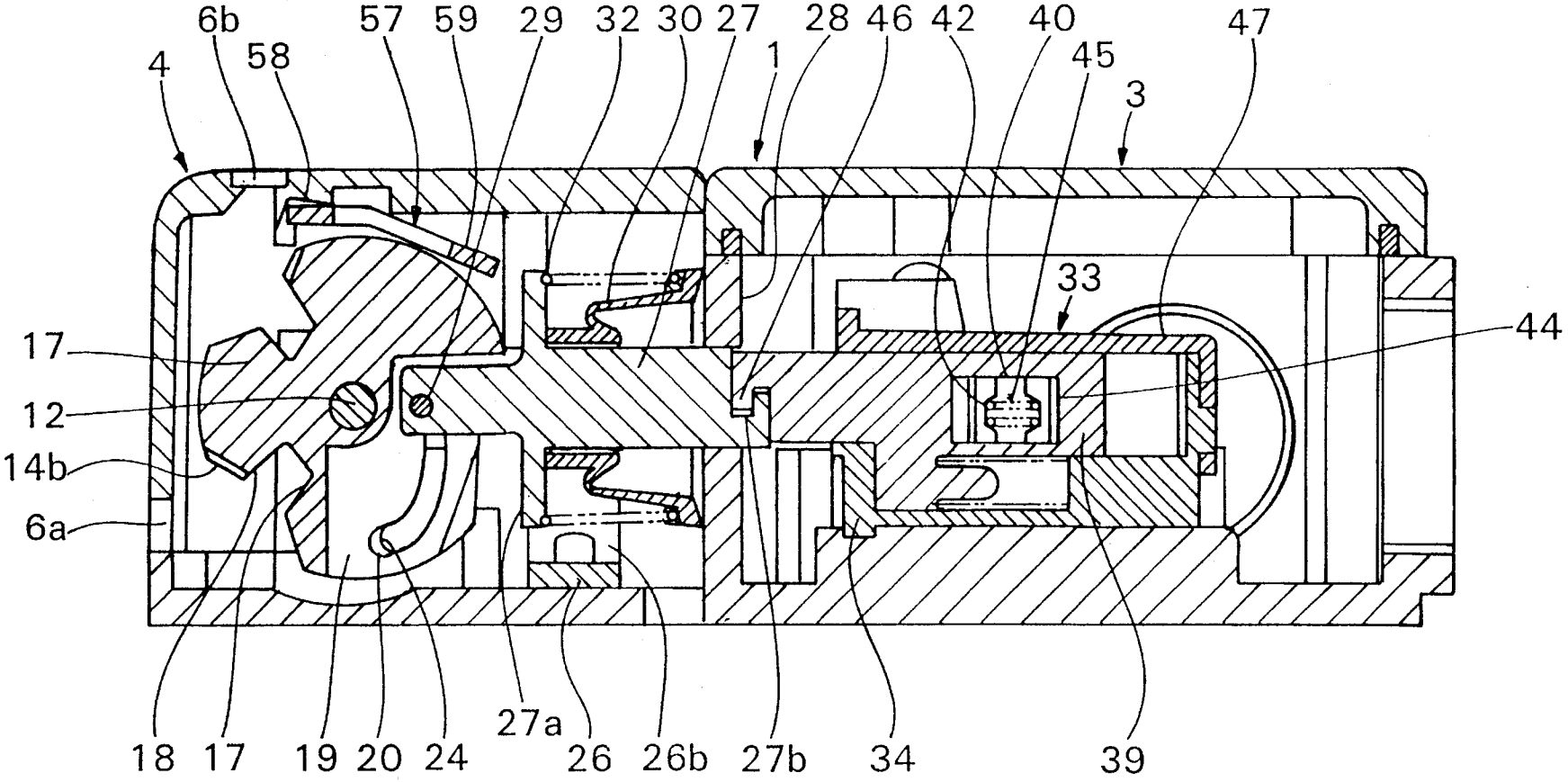
FIG. 11 is a vertical cross-sectional view taken along the line 11—11 in FIG. 10.
Figure 12A:
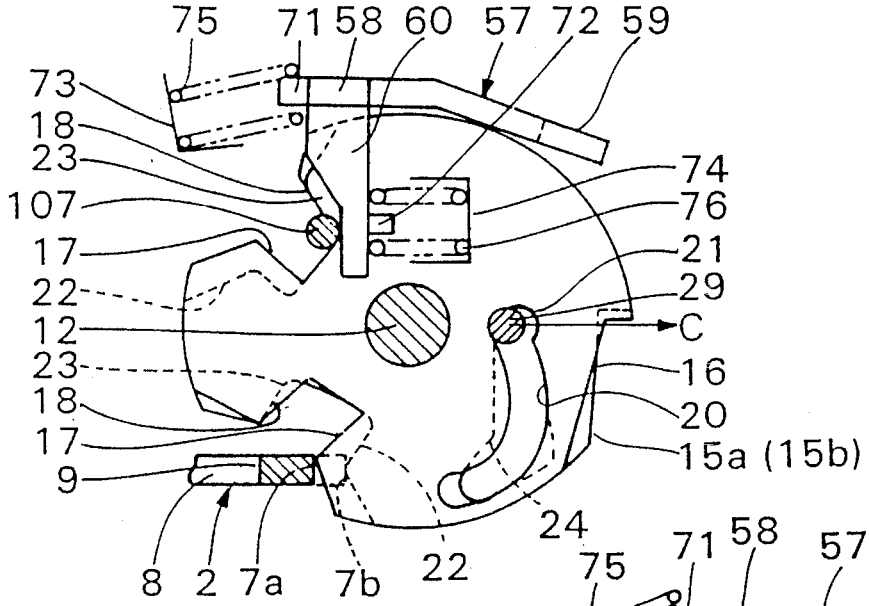
FIGS. 12(*a*) to 12(*c*) are diagrammatic views showing the interaction of the actuator and the cam plates.
Figure 12B:
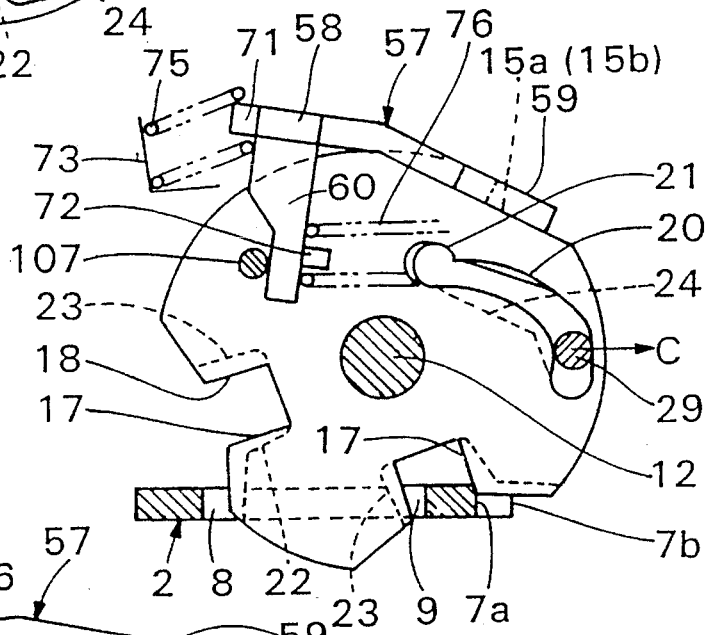
Figure 12C:
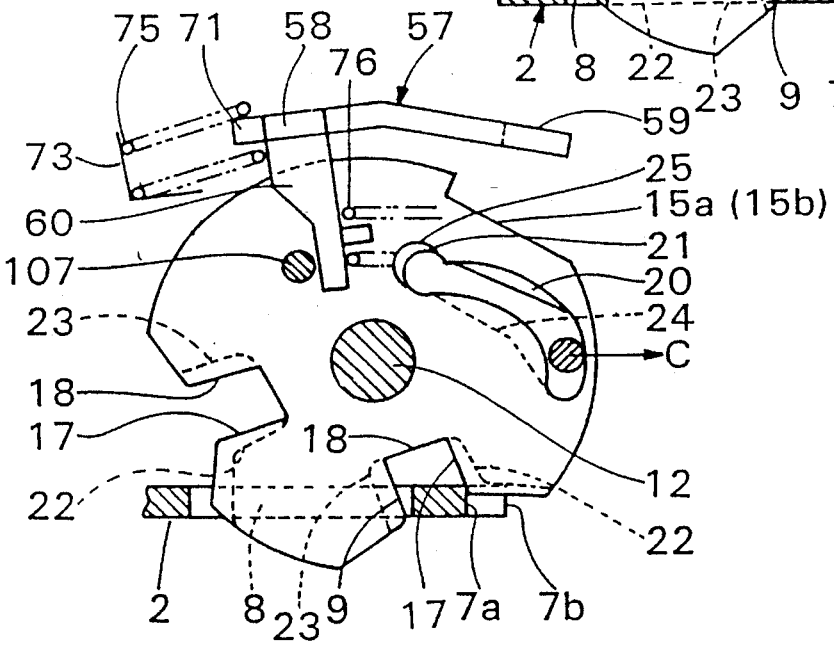

Once the protective door is closed and the normally closed contact points are opened and the normally opened ones are closed in accordance with the backward movement of the switching rod 39, the switching rod is locked in this state unless it is unlocked. An unlocking device can be added to the switch assembly. By referring to FIGS. 10 to 12, an example of the unlocking mechanism will be described:

A lock ledge 57 includes a base portion and an eaves portion. The base portion has end portions 58 rotatably supported by the supports 11, and the eaves portion extends over the cam plates 14*a* and 14*b* and terminates at an edge portion 59 (FIG. 11). As shown in FIG. 10, the eaves portion has a rectangular opening wide enough to cover the total width of the three cam plates 13, 14*a* and 14*b*. As shown in FIG. 12, tile end portion 58 is connected to an arm 60 extending downward and a projection 71 for supporting a spring 75. The arm 60 is provided with a shelf 72 for supporting a spring 76. The springs 75 are supported between the projections 71 and recesses 73 produced on the supports 11. Likewise, the spring 76 is supported between the shelves 72 and recesses 74 produced on the supports 11. The lock ledge 57 is rotatable in the clockwise direction in FIG. 11. The edge portion 59 of the lock ledge 57 oppresses the peripheral surfaces of the cam plates 13, 14*a* and 14*b*.

Referring to FIG. 10, when an electro-magnet (commonly called "solenoid") is energized, the actuator releasing block 10 disengages the edge portion 59 of the locking ledge 57 from a locking recess 15*a* of the cam plate 13 and locking recesses 15*b* of the cam plates 14*a* and 14*b*. The electro-magnet 104 has a movable iron core 105 connected to a connecting rod 106, and a releasing ledge 107 for transmitting the motion of the connecting rod 106 to the operating block 4. When the movable iron core 105 is magnetically attracted, the releasing ledge 107 is shifted in the direction of arrow in FIGS. 10 and 12(*c*), thereby rotating the arms 60 in the counterclockwise direction in FIG. 12.

Referring to FIGS. 12(*a*) to 12(*c*), the operation will be described:

FIG. 12(*a*) shows that the recessed portion 7*a* and projecting portions 7*b* of the actuator 2 are placed into engagement with the start sides 17 and 22 of the cam plates 13, and 14*a* and 14*b*. At this stage, the lock ledge 57 keep contact with the surfaces of the cam plates 13, 14*a* and 14*b* staying ahead of the locking recesses 15*a* and 15*b*.

A further advancement of the actuator 2 causes the cam plates 13, 14*a*, and 14*b* together, thereby enabling the cam follower pin 29 to shift in the direction C in FIG. 12(*a*). The pin 29 reaches the point shown in FIG. 12(*b*) where the contact points 35 and 41 are opened and the contact points 37 and 43 are closed in accordance with the backward movement of the switching rod 39. At this moment, the edge portion 59 of the lock ledge 57 fits in the locking recesses 15*a* and 15*b* and the lock ledge 57 rotates in the clockwise direction. At the same time a lower part of each cam plate 13, 14*a* and 14*b* rests in the aperture 8 of the actuator 2 so that the return sides 18 and 23 of the cam plates stand face to face with the inside wall portion 9 of the aperture 8.

When the actuator 2 is withdrawn from the switch assembly 1, the inside wall portion 9 of the aperture 8 pushes the return sides 18 and 23, thereby forcing the cam plates 13, 14*a* and 14*b* to rotate in the clockwise direction. At this stage, if an operator tries to open the door intentionally or carelessly or any force acts thereon to open the door, the actuator 2 will be restrained from withdrawal because of the impossibility of the cam plates 13, 14*a* and 14*b* to rotate.

The locked cam plates are released by energizing the electromagnet (solenoid) of the releasing block 10. The energization drives the releasing ledge 107 in the direction of arrow to push the arms 60. The strength of the upper spring 75 is stronger than that of the lower spring 76 so that the lock ledge 57 is rotated around the pivoted point against the lower spring 76. The edge portion 59 of the lock ledge 57 is released from the recesses 15*a*, 15*b*. In this way the cam plates 13, 14*a* and 14*b* are unlocked.

Figure 13:
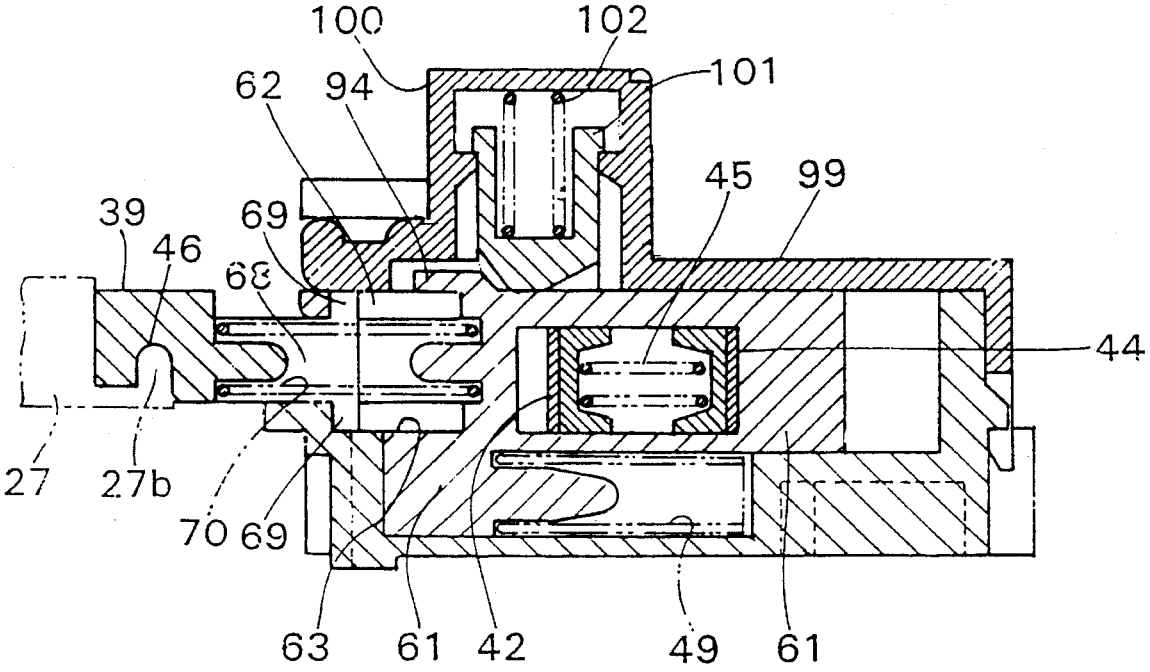
FIG. 13 is a cross-sectional view showing a delay mechanism in the switch section in the contact-point block.
Figure 14:
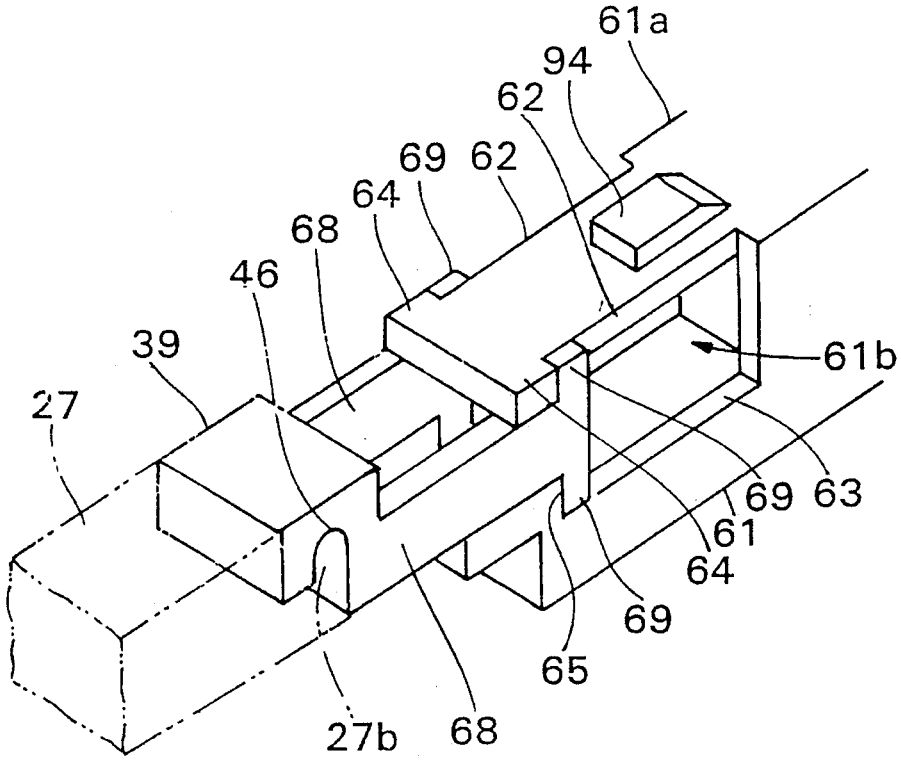
FIG. 14 is a perspective view showing a portion of the delay mechanism shown in FIG. 13.
Figure 15A:
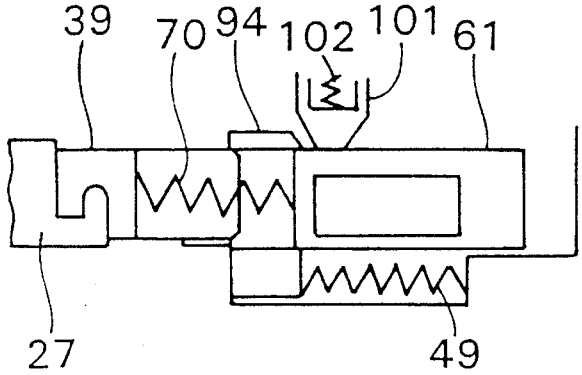
FIGS. 15(*a*) to 15(*d*) are diagrammatic cross-sectional views showing the process of interaction of the delay mechanism shown in FIG. 13, when the door is closed.
Figure 15A:
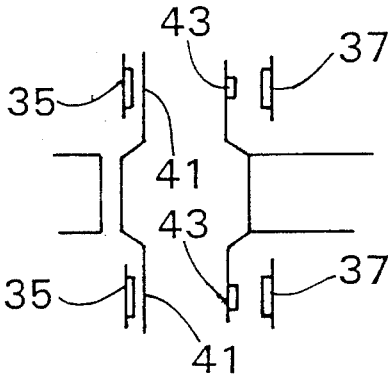
Figure 15B:
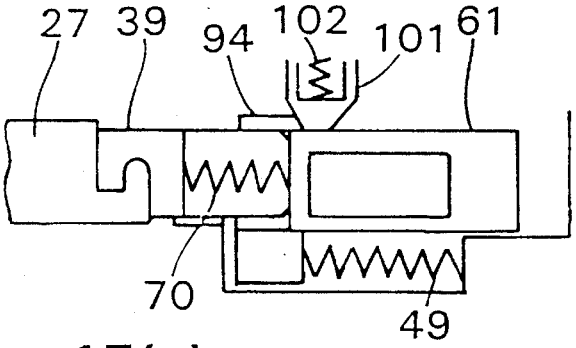
Figure 15B:
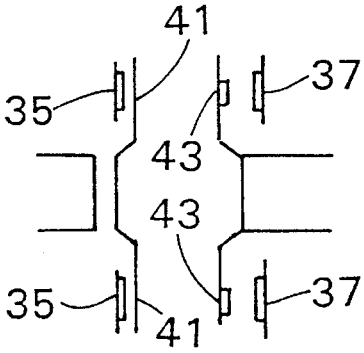
Figure 15C:
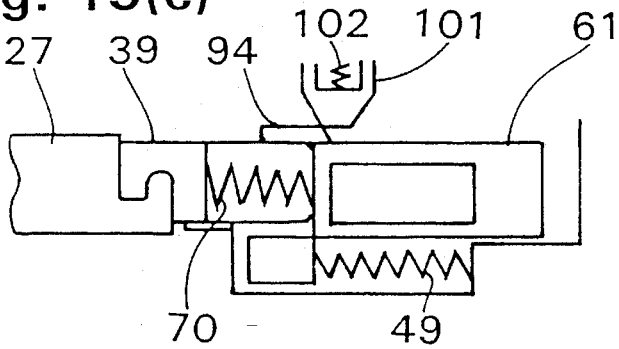
Figure 15C:
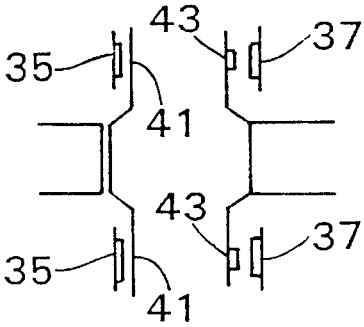
Figure 15D:
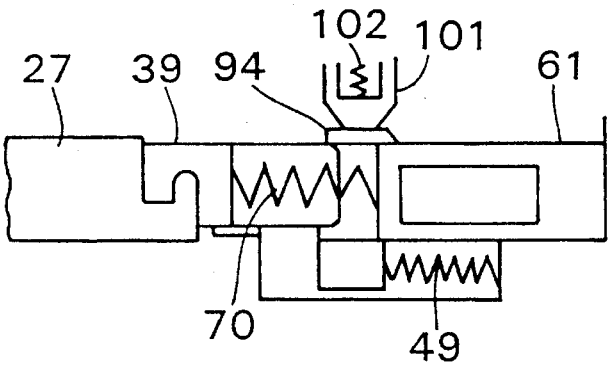
Figure 15D:
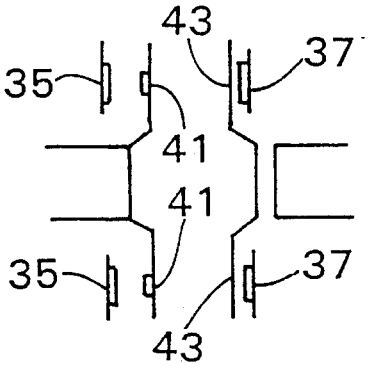
Figure 16A:
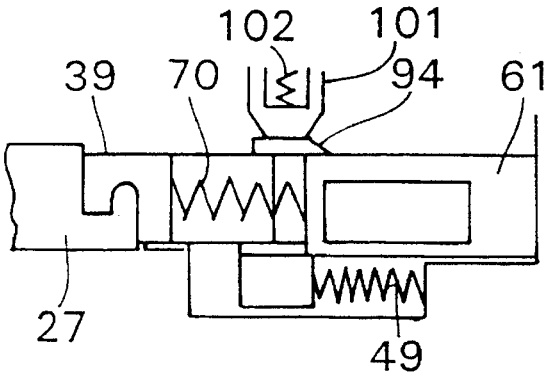
FIGS. 16(*a*) to 16(*d*) are diagrammatic cross-sectional views showing the process of interaction of the delay mechanism shown in FIG. 13, when the door is opened.
Figure 16A:
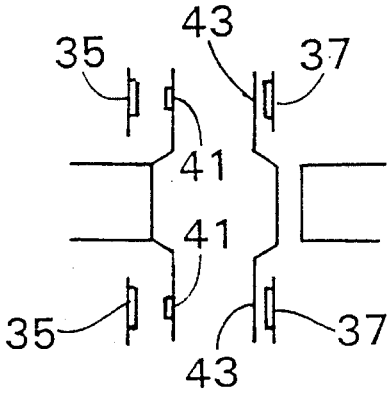
Figure 16B:
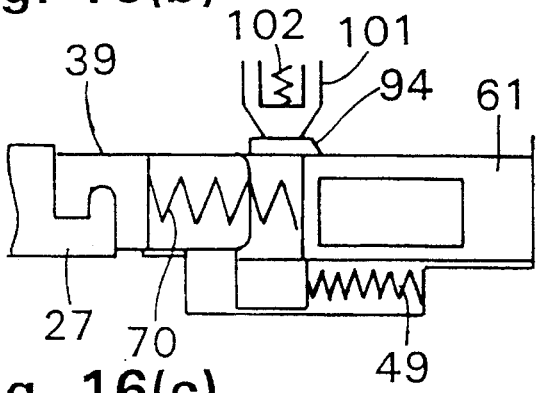
Figure 16B:
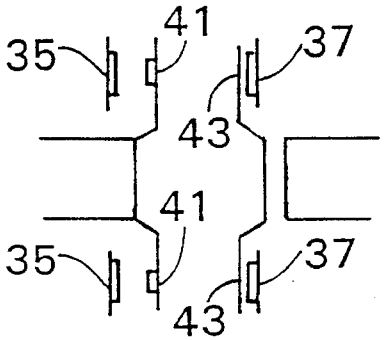
Figure 16C:
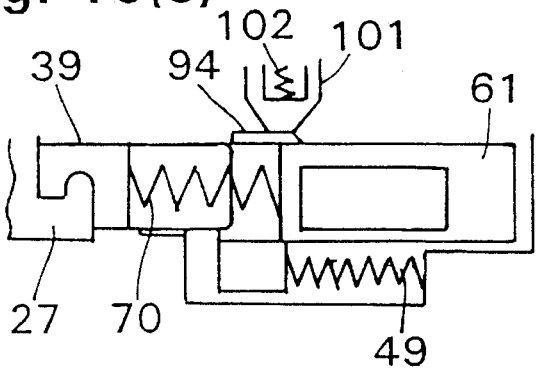
Figure 16C:
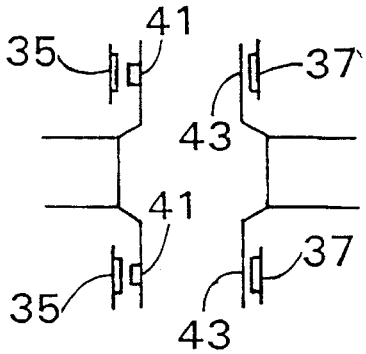
Figure 16D:
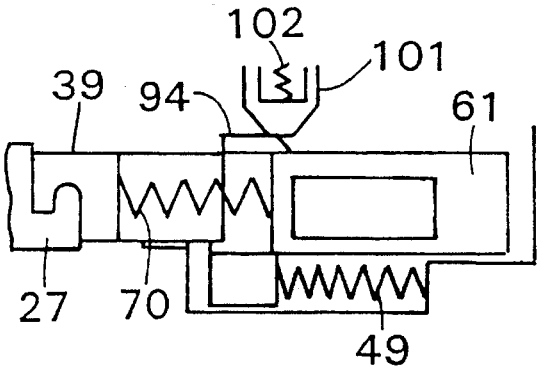
Figure 16D:
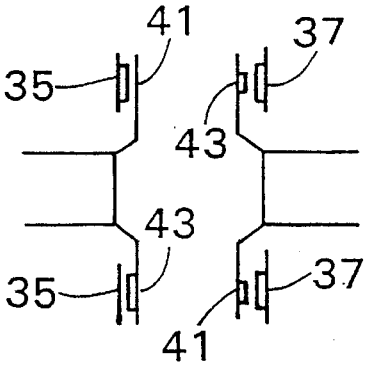

Referring to FIGS. 13 and 14, a modified version of the switch section 33 will be described:

This example is characterized in that the normally closed contact points 35 and 41 are opened and the normally closed contact points 37 and 43 are opened at a time interval (time lag) after the cam plates 13, 14*a* and 14*b* are locked.

A contact-point holder 61 supports the terminal plates 42 and 44 with a space maintained by the spring 45. A return spring 49 is disposed so as to return the holder 61. The switching rod 39 moves right and left in FIG. 13 by being engaged with the operating rod 27 in the above-mentioned manner. The switching rod 39 has a hollow body having an open end in which a spring 70 is accommodated and a slider portion 38 on both sides extended toward the contact-point holder 61, this slider portion being hereinafter referred to as "slider 68". The holder 61 has a rectangular recess 61*b* on each side, and a ceiling 61*a* having an engager 94 on the top surface. The ceiling 61*a* has slide rails 62 and a pair of horn portions 64 extended sideways for engagement with the slider 68 in a manner described below. The rectangular recess 61*b* has slide rails 63, both slide rails being for a slider 68 having a pair of horn portions 69 which slide on the slide rails 62 and 63. The holder 61 is provided with a step 65 produced crosswise for engagement with the lower horn portions 69 of the slider 68. Normally as shown in FIGS. 13 and 14, the slider 68 is biased to the left under the action of the spring 70 with the horn portions 69 being engaged with the extended portions 64 of the ceiling 61*a* and the step 65 of the holder 61.

The contact-point holder 61 is provided with a box 100 in which a vertically movable member 101 is accommodated. The member 101 has a slant surface which matches that of the engager 94 of the ceiling 61*a*. Normally as shown in FIG. 13, the member 101 is biased downward until the member 101 is located immediately behind the engager 94 under the action of a spring 102. The strength of the spring 70 is larger than that of the spring 45.

Referring to FIGS. 15 and 16, an example of the operation of the switch assembly 1 will be described wherein FIGS. 15 show the operation occurring when the door is closed, and FIGS. 16 show that occurring when the door is opened:

In FIGS. 15, before the actuator 2 is inserted into the switch assembly 1, the switching rod 39 stands at its forward position (FIG. 15(*a*) where the spring 45 maintains the closure of the contact points 35 and 41 (FIG. 15(*a*)', keeping the "on" condition.

The door is closed and the actuator 2 is inserted into the switch assembly 1. The operating rod 27 and the switching rod 39 is pushed backward together against the spring 70 (FIG. 15(*b*) where the holder 61 remains stationary because of a difference in strength between the springs 70 and 102 and the slant surface of the engager 94, thereby maintaining the closure of the contact points 35 and 41 (FIG. 15(*b*)'.

As the switching rod 39 further advances, its backward end comes into abutment with the holder 61 and the engager 94 pushes up the member 101 (FIG. 15(*c*) where the cam plates 13, 14*a* and 14*b* are locked in the above-mentioned manner, thereby preventing the switching rod 39 from returning (the forward movement).

Then, the member 101 comes to mount on the engager 94, thereby removing the braking effect given by the member 101 upon the holder 61. Having no brake, the spring 70 is set free from frustration and expands to push the holder 61 backward (FIG. 15(*d*). The contact points 43 are brought into contact with the fixed contact points 37 (FIG. 15(*d*)') under the action of the spring 45, thereby switching on the safety switch circuit. The "on" condition of the safety switch circuit is kept under the action of the spring 45 until the cam plates 13, 14*a* and 14*b* are unlocked by the releasing block 10.

Now, referring to FIG. 16, the operation will be described step by step when the door is opened:

An electro-magnet (solenoid) is energized to unlock the cam plates 13, 14*a* and 14*b*. The opening of the door is accompanied by the withdrawal of the actuator 2 out of the switch assembly 1. The switching rod 39 is withdrawn to the left (forward movement) in FIG. 16(*a*). The holder 61 still remains stationary by the engagement of the member 101 with the engager 94.

When the switching rod 39 advances forward (to the left) to a point where the horn portions 69 come into abutment with the horn portion 64 and the step 65, the holder 61 follows the forward movement of the switching rod 39 (FIG. 16(*c*). Since a force restraining the member 101 is diminished, the spring 45 restores its strength so that the contact points 43 are disengaged from the points 37, thereby switching off a source of power for the machinery. When the holder 61 is further advanced forward (FIG. 16(*d*) to where the member 101 reaches a point near the slant surface of the engager 94, the closure of the contact points 35 and 41 is restored (FIG. 16(*d*)'). Herein the machinery is deenergized, and the actuator 2 is completely withdrawn out of the switch assembly 1 (FIG. 1).

Figure 17:
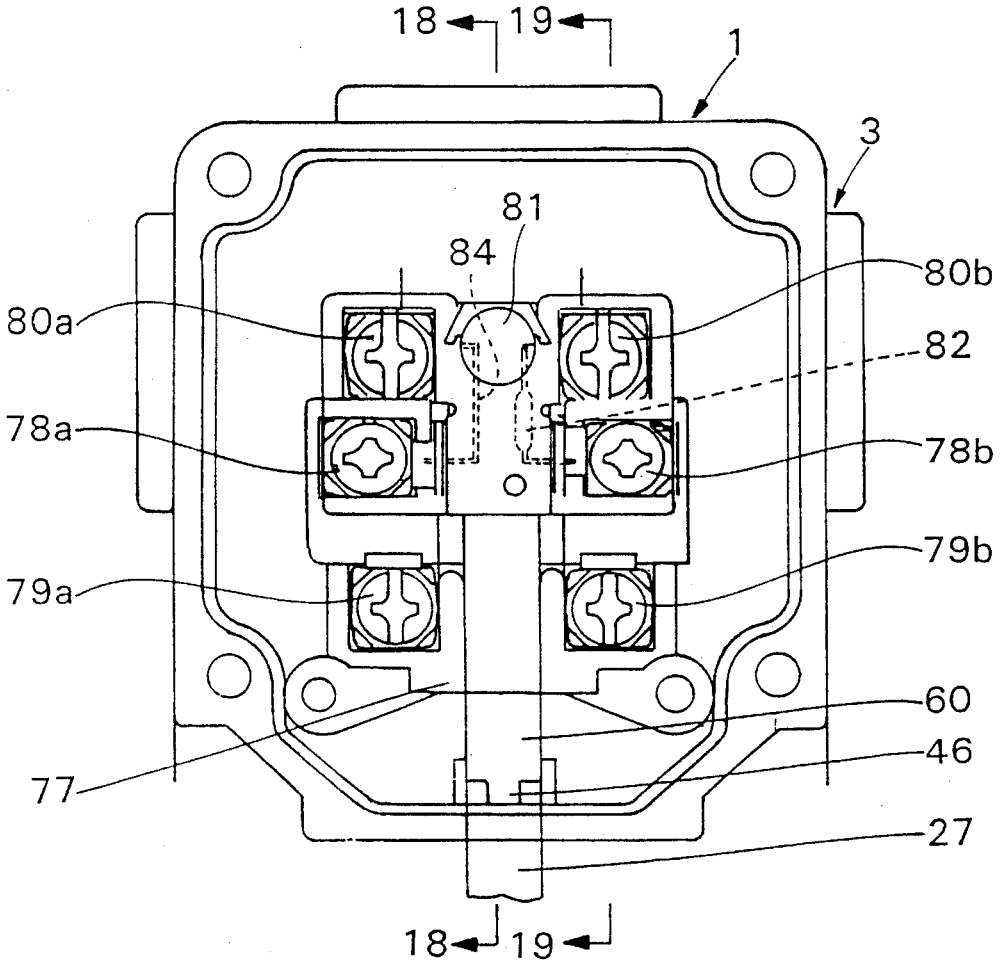
FIG. 17 is a plan view showing another modified version of a switch section in the contact-point block.
Figure 18:
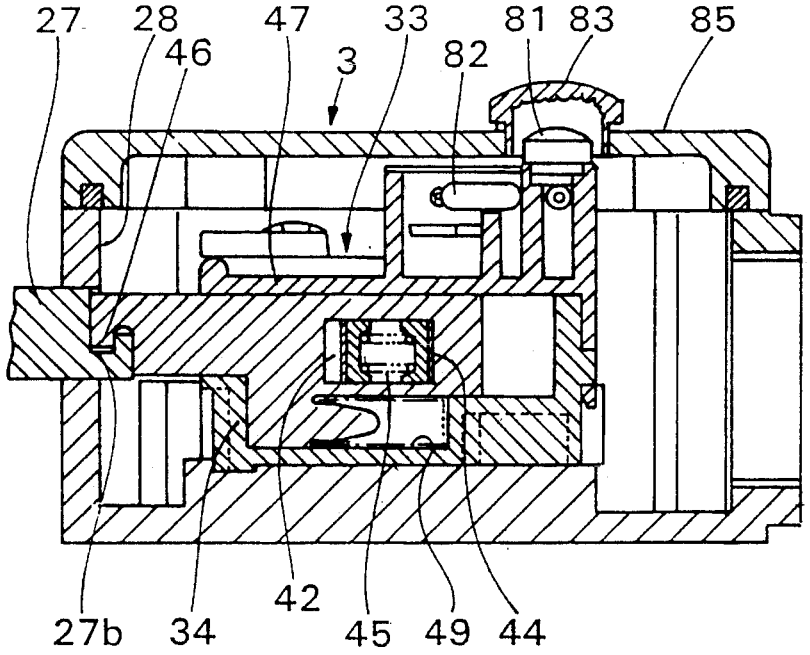
FIG. 18 is a cross-sectional view taken along line 18—18 in FIG. 17.
Figure 19:
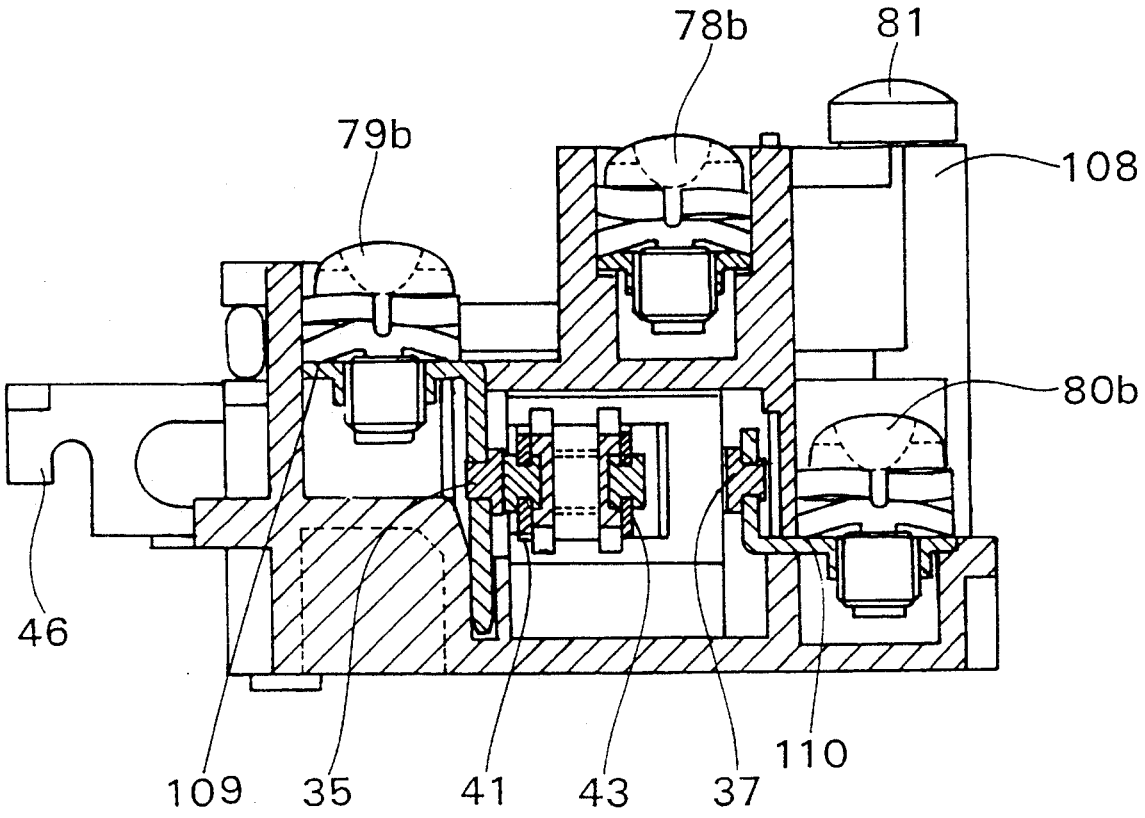
FIG. 19 is a cross-sectional view taken along the line 19—19 in FIG. 17.

Referring to FIGS. 17, 18 and 19, a modified version of the switch section 33 will be described:

A plastics molded terminal box 77 houses terminals 78*a* and 78*b* mounted highest, terminals 79*a* and 79*b* next highest, terminals 80*a* and 80*b* lowest, wherein the terminals 79*a* and 79*b* are normally closed, and the terminals 80*a* and

80*b* are normally opened. These six terminals are arranged three by three on either side of the operating rod. Either of the terminals 79*a* or 79*b*, which are normally closed, is electrically connected to the terminal 35 through a conductor 109, and either of the terminals 80*a* or 80*b* is electrically connected to the terminal 37 through a conductor 110. The rearward end portion 108 is formed as high as the terminals 79*a* and 79*b*, and is provided with a lamp (LED) 81 in which multiple light emitting diodes are arranged in series connected in series to a resistor 82, and to the terminals 78*a* and 78*b* through a lead line 84. There is provided a lens 83 on a cover 85 above the lamp 81.

Industrial Applicability

According to the present invention, the safety switch assembly can be as compact as 9 cm(W)×2 cm(L)×3,5 cm(H). Because of the compact size, the safety switch assembly finds many applications. The switch assembly is protected against mischievous or malicious operation by using any other tool than the regular actuator.

We claim:

1. A safety switch unit comprising:

a switch assembly for being attached to a structure proximate a door;

an actuator for being attached to the door proximate the switch assembly and for being inserted and locked within the switch assembly when the door is closed, the actuator including first and second portions projecting in an actuating direction, the second portion projecting farther than the first portion, the first and second portions being inserted into the switch assembly along an insertion path;

a cam shaft within the switch assembly, the cam shaft having an axis extending transversely with respect to the actuating direction, the axis being offset from the insertion path;

a first disc-shaped cam plate rotatably mounted on the cam shaft, the first cam plate having a first cam groove, a first periphery, a first recess in the first periphery, and a first side in the first recess, the first side for being initially contacted by the first portion of the actuator when the actuator is inserted within the switch assembly, the first cam plate being rotated by the insertion of the actuator;

a second disc-shaped cam plate rotatably mounted on the cam shaft adjacent the first cam plate, the second cam plate having a second cam groove, a second periphery, a second recess in the second periphery, and a second side in the second recess, the second side for being initially contacted by the second portion of the actuator when the actuator is inserted within the switch assembly, the second cam plate being rotated by the insertion of the actuator;

a first cam follower pin moving in and along the first cam groove;

a second cam follower pin moving in and along the second cam groove;

an operating rod connected to the first and second cam follower pins, the rotation of the first and second cam plates moving the first and second cam follower pins along the respective first and second cam grooves to axially shift the operating rod; and a switch section for effecting safety switching operation in accordance with the axial movement of the operating rod, the switch section having first and second electrical contact points forming a switch, the switch being in one of an open state and a closed state during a first phase of the insertion of the actuator within the switch assembly before the actuator is locked within the switch assembly, and being in the other of the open state and the closed state during a second phase of the insertion of the actuator within the switch assembly when the actuator is locked within the switch assembly.

2. The safety switch unit according to claim 1 wherein the first side of the first cam plate is angularly positioned relative to the second side of the second cam plate such that the first portion of the actuator initially contacts the first side and the second portion of the actuator initially contacts the second side substantially simultaneously, wherein the first and second cam plates rotate substantially simultaneously when the actuator comes into abutment therewith.

3. The safety switch unit according to claim 1 wherein the switch section comprises a light emitting diode and a lens disposed over the light emitting diode.

4. A safety switch unit comprising:

a switch assembly for being attached to a structure proximate a door;

an actuator for being attached to the door proximate the switch assembly and for being inserted and locked within the switch assembly when the door is closed, the actuator including first and second portions projecting in an actuating direction, the second portion projecting farther than the first portion, the first and second portions being inserted into the switch assembly along an insertion path;

a cam shaft within the switch assembly, the cam shaft having an axis extending transversely with respect to the actuating direction, the axis being offset from the insertion path;

a first disc-shaped cam plate rotatably mounted on the cam shaft, the first cam plate having a first cam groove, a first periphery, a first recess and a first locking step in the first periphery, and a first side in the first recess, the first side for being initially contacted by the first portion of the actuator when the actuator is inserted within the switch assembly, the first cam plate being rotated by the insertion of the actuator;

a second disc-shaped cam plate rotatably mounted on the cam shaft adjacent the first cam plate, the second cam plate having a second cam groove, a second periphery, a second recess and a second locking step in the second periphery, and a second side in the second recess, the second side for being initially contacted by the second portion of the actuator when the actuator is inserted within the switch assembly, the second cam plate being rotated by the insertion of the actuator;

a first cam follower pin moving in and along the first cam groove;

a second cam follower pin moving in and along the second cam groove;

an operating rod connected to the first and second cam follower pins, the rotation of the first and second cam plates moving the first and second cam follower pins along the respective first and second cam grooves to axially shift the operating rod;

a switch section for effecting safety switching operation in accordance with the axial movement of the operating rod, the switch section having first and second electrical contact points forming a switch, the switch being in one of an open state and a closed state during a first phase of the insertion of the actuator within the switch assembly before the actuator is locked within the switch assembly, and being in the other of the open state and the closed state during a second phase of the insertion of the actuator within the switch assembly when the actuator is locked within the switch assembly;

a lock ledge rotatable on an axis parallel to the cam shaft axis and including a base portion and an eaves portion extending over the cam plates, the eaves portion including an opening spanning across the first and second cam plates, the insertion of the actuator rotating the first and second cam plates to bring the first and second locking steps into releasable holding engagement with the eaves portion; and a releasing ledge for being selectively operated to rotate the lock ledge to move the eaves portion away from the first and second locking steps.

5. The safety switch unit according to claim 4 wherein the switch section comprises a stationary member having the first electrical contact point, a holder having the second electrical contact point, a spring elastically connecting the holder to the operating rod, a restraining means for restraining the movement of the holder during the first phase, and a releasing means for releasing the restraining means upon commencement of the second phase.

6. The safety switch unit according to claim 4 wherein the switch section comprises a light emitting diode and a lens disposed over the light emitting diode.

* * * * *